United States Patent [19]

Sasaki et al.

[11] Patent Number: 4,540,658

[45] Date of Patent: Sep. 10, 1985

[54] SILVER HALIDE COLOR PHOTOGRAPHIC PRODUCTS

[75] Inventors: Masao Sasaki; Kaoru Onodera, both of Odawara, Japan

[73] Assignee: Konishiroku Photo Industry Co. Ltd., Tokyo, Japan

[21] Appl. No.: 507,588

[22] Filed: Jun. 24, 1983

[30] Foreign Application Priority Data

Jun. 29, 1982 [JP] Japan ..... 57-113486
Jun. 29, 1982 [JP] Japan ..... 57-113487

[51] Int. Cl.[3] ..... G03C 7/26

[52] U.S. Cl. ..... 430/551; 430/512; 430/552; 430/553; 430/556; 430/557; 430/629; 430/931

[58] Field of Search ..... 430/512, 551, 629, 931, 430/552, 553, 556, 557

[56] References Cited

U.S. PATENT DOCUMENTS 4,228,235 10/1980 Okonogi et al. ..... 430/551
4,252,893 2/1981 Iwamuro et al. ..... 430/551
4,307,175 12/1981 Pollet et al. ..... 430/551

*Primary Examiner*—J. Travis Brown
*Attorney, Agent, or Firm*—Finnegan, Henderson, Farabow, Garrett & Dunner

[57] ABSTRACT

A silver halide color photographic product with dye images having improved fastness to light is disclosed. The product has at least one dye image forming layer on a support and further includes at least one of the compounds of formula (I) or (II) in said dye image forming layer and/or an adjoining or an adjacent layer:

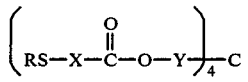

(I)

wherein R is an alkyl group, an aryl group or a heterocyclic group; X is an alkylene group; and Y is an alkylene or arylene group; and

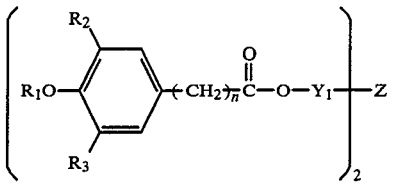

(II)

wherein $R_1$ is a hydrogen atom, an alkyl group or an aryl group; $R_2$ and $R_3$ are each an alkyl group; $Y_1$ is an alkylene or arylene group; Z is an oxygen atom, a sulfur atom, a sulfonyl group, a carbonyl group or an alkylene group; and n is an integer of 1 to 20.

19 Claims, No Drawings

SILVER HALIDE COLOR PHOTOGRAPHIC PRODUCTS

FIELD OF THE INVENTION

The present invention relates to silver halide color photographic products (hereunder referred to simply as color photographic products), and more particularly, to color photographic products with dye images having an improved fastness to light.

BACKGROUND OF THE INVENTION

Silver halide color photographic materials are prepared by coating a support with three silver halide color photographic emulsion layers selectively rendered sensitive to blue, green and red lights. For example, photographic materials for color negatives have a blue-sensitive emulsion layer, a green-sensitive emulsion layer and a red-sensitive emulsion layer successively arranged on a support, with the first mentioned layer being on the top. A bleachable yellow filter layer is disposed between the blue- and green-sensitive layers to absorb any blue light that penetrates the blue-sensitive layer. Other intermediate layers having specific purposes are placed between each emulsion layer, and a protective layer is formed as the outermost layer. Photographic materials for color printing paper have a red-sensitive emulsion layer, a green-sensitive emulsion layer, and a blue-sensitive emulsion layer, successively formed on a support, with the red-sensitive layer being on the top. As in the photographic materials for color negatives, an UV absorbing layer and other intermediate layers having specific purposes, as well as a protective layer are incorporated in the photographic materials for color printing paper. In either case, the respective emulsion layers may be arranged in orders other than those specified above. Instead of using only one emulsion layer sensitive to a particular spectrum, two layers having sensitivity to substantially the same spectrum may be used. After exposure to light, these silver halide color photographic materials are developed by color developing agents such as aromatic primary amine compounds, and the oxidation product of the color developing agent formed as a result of development of the silver halide grains reacts with a dye forming coupler to provide a dye image. In this photographic processing, cyan dye images are formed by phenol or naphthol cyan couplers; magenta dye images are formed by 5-pyrazolone, pyrazolinobenzimidazole, pyrazolotriazole, indazolone or cyanoacetyl magenta couplers; and yellow dye images are formed by acylacetamide or benzoylmethane yellow couplers. These dye forming couplers are incorporated in either the photographic emulsion layers or the developer.

The dye images on the color photographic products produced by the process described above may fade upon prolonged exposure to light during storage. Alternatively, the photographic products are stored in a dark area and will be exposed to light for only a short time, but depending upon the condition of the storage, a serious fading may occur. The first type of fading is generally referred to as light fading, and the second type is called dark fading. In order to prepare images of archival quality from color photographic products, the degree of fading, whether it is light fading or dark fading, must be held to minimum. However, no conventional color photographic material provides dye images having satisfactory resistance to fading. Furthermore, cyan, magenta and yellow dyes fade by different degrees, and the overall color balance among the dye images may be change after storage. To solve these problems, selected couplers capable of forming less fading dye images have been used, or various anti-fading agents have been employed.

In order to prevent light fading in the dye images, methods have been proposed for incorporating UV absorbers or UV absorbing filter layers in the color photographic product. But to achieve a satisfactory degree of light fastness, a relatively large amount of UV absorber is necessary, and if it is used too much, it stains the final color photographic image or its solubility in high-boiling solvents is decreased to increase the chance of crystallization. As a further disadvantage, if the color photographic image is exposed to strong actinic radiation for a prolonged period, the UV absorber is decomposed and its effectiveness is decreased to cause accelerated light fading. More importantly, UV absorbers are entirely ineffective against fading due to visible light. Agents effective against light fading have been proposed, and among them are compounds having a phenolic hydroxyl group or a group capable of forming a phenolic hydroxyl group upon hydrolysis: Japanese Patent Publications Nos. 31256/73 and 31625/73 propose the use of bisphenols; U.S. Pat. No. 3,069,262 discloses pyrogallol, gallic acid and esters or acyl derivatives thereof; U.S. Pat. Nos. 3,432,300 and 3,574,627 disclose 6-hydroxychromans; U.S. Pat. No. 3,573,050 describes 5-hydroxychromans; and Japanese Patent Publication No. 20977/74 discloses 6,6'-dihydroxy-2,2'-bispyrochromans. Some of these compounds are certainly effective against light fading, but they are entirely ineffective against dark fading or may even accelerate the same. Others are effective for only a certain period of time and thereafter their effectiveness is greatly reduced or even lost completely. Among the compounds listed above, some are known to contaminate the dye images by staining. As a further defect, compounds effective against fading in magenta dye images enhance the fading of cyan dye images.

SUMMARY OF THE INVENTION

Therefore, one object of the present invention is to provide a color photographic product that can be stored for an extended period with minimum fading in dye images.

Another object of the present invention is to provide a color photographic product having a particularly great resistance to light fading.

Still another object of the present invention is to provide a color photographic product that retains the good color balance among the dye images even if it experiences light fading.

A further object of the present invention is to provide a color photographic product with dye images rendered highly light-fast by compounds that are highly soluble in high-boiling solvents and which are by no means detrimental to the other photographic characteristics.

A still further object of the present invention is to provide a simple and effective method for stabilizing dye images.

These objects of the present invention can be accomplished by a silver halide color photographic product having at least one dye image forming layer on a support, which further contains at least one of the compounds of formula (I) or (II) in said dye image forming layer and/or an adjoining or an adjacent layer:

(I)

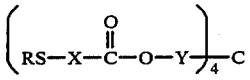

wherein R is an alkyl group, an aryl group or a heterocyclic group; X is an alkylene group; and Y is an alkylene or arylene group; and (II)

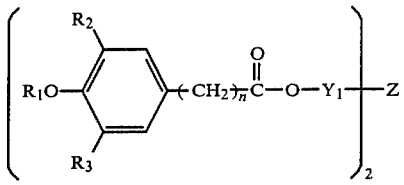

wherein $R_1$ is a hydrogen atom, an alkyl group or an aryl group; $R_2$ and $R_3$ are each an alkyl group; $Y_1$ is an alkylene or arylene group; Z is an oxygen atom, a sulfur atom, a sulfonyl group, a carbonyl group or an alkylene group; and n is an integer of 1 to 20. In preferred embodiments, an alkyl group represented by R has 1 to 20 carbon atoms; an aryl group represented by R is a phenyl group or a phenyl group substituted with an alkyl group having 1 to 5 carbon atoms; an alkylene group represented by X has 1 to 4 carbon atoms; an arylene group represented by Y is a phenylene group; X and Y are each an alkylene group having 1 to 4 carbon atoms; an alkyl group represented by $R_1$ has 1 to 6 carbon atoms; an aryl group represented by $R_1$ is a phenyl group; an alkyl group represented by each of $R_2$ and $R_3$ has 1 to 6 carbon atoms; an alkylene group represented by $Y_1$ has 1 to 4 carbon atoms; an arylene group represented by $R_1$ is a phenylene group; Z is an oxygen atom or a sulfur atom; the dye image forming layer and/or the adjoining or adjacent layer contain a yellow or cyan coupler, a preferred yellow coupler having formula (III):

(III)

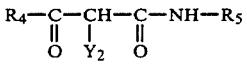

(wherein $R_4$ is an alkyl group or an aryl group; $R_5$ is an aryl group; and $Y_2$ is a hydrogen atom or a group that is eliminated during color development reaction.) and a preferred cyan coupler having formula (V):

(V)

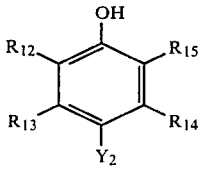

(wherein $Y_2$ is the same as defined in formula (III); and $R_{12}$, $R_{13}$, $R_{14}$ and $R_{15}$ are each a hydrogen atom, a halogen atom, an alkyl group, a carbamoyl group, a sulfamoyl group, an amide group, a sulfonamide group, a phosphamide group or a ureido group.);

the symbol n is a integer of 1 to 5;

and each group represented by R has 1 to 20 carbon atoms.

DETAILED DESCRIPTION OF THE INVENTION

The compounds of formulae (I) and (II) used in the present invention illustrated by, but are by no means limited to, the following examples:

(1)

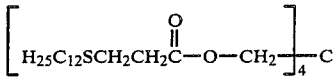

(2)

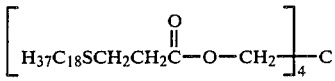

(3)

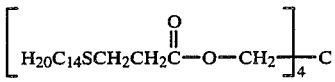

(4)

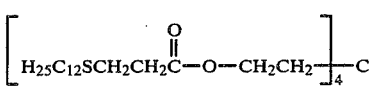

(5)

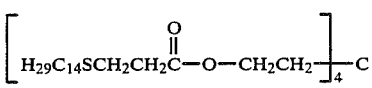

(6)

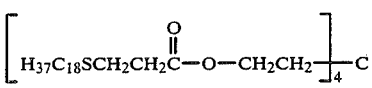

(7)

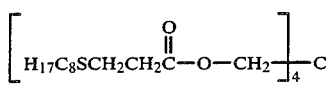

(8)

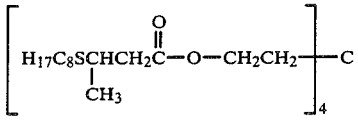

(9)

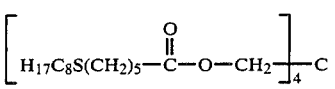

(10)

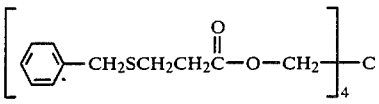

(11)

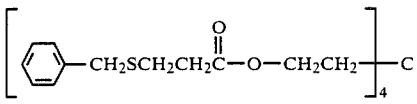

(12)

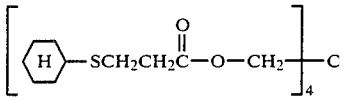

-continued (13)

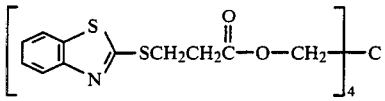

(14)

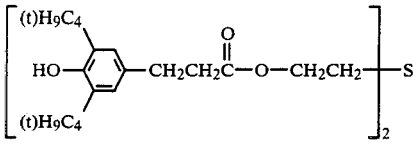

(15)

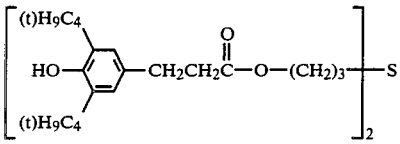

(16)

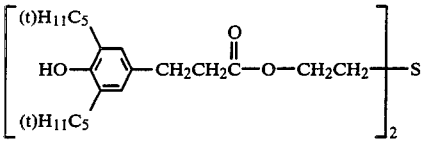

(17)

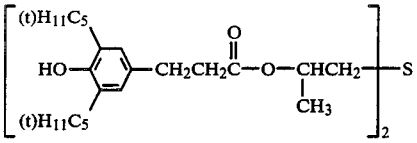

(18)

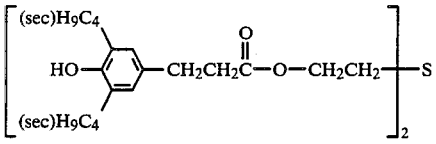

(19)

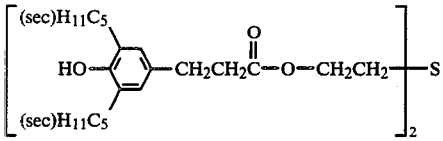

(20)

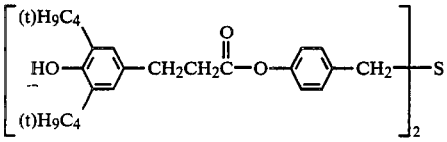

(21)

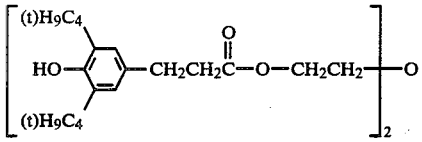

(22)

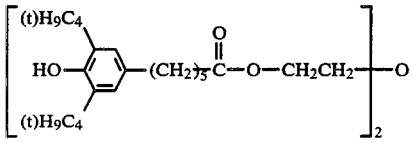

-continued (23)

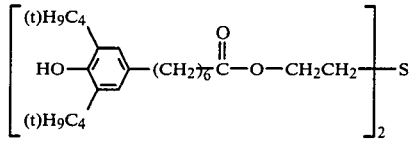

(24)

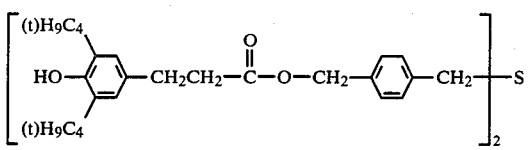

(25)

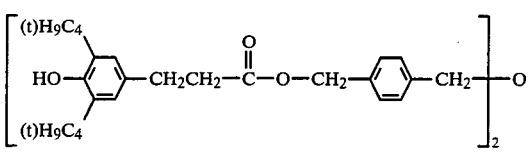

(26)

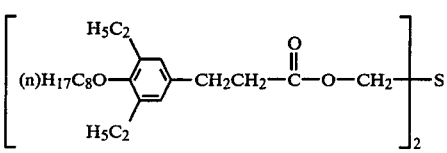

The above listed compounds are known and can be readily synthesized by known methods such as methods disclosed in U.S. Pat. No. 3,758,549 to Dexter et al. and British Pat. No. 1,448,729.

Any known dye image forming couplers may be used unlimitedly in the present invention. Preferred yellow couplers are those having formula (III):

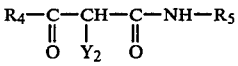

(III)

wherein $R_4$ is an alkyl group or an aryl group; $R_5$ is an aryl group; $Y_2$ is a hydrogen atom or a group that is eliminated during color development reaction. Particularly preferred yellow couplers are those having formula (III'):

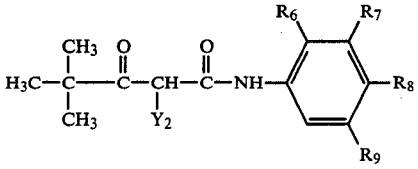

(III')

wherein $R_6$ is a halogen atom, an alkoxy group or an aryloxy group; $R_7$, $R_8$ and $R_9$ are each a hydrogen atom, a halogen atom, an alkyl group, an alkenyl group, an alkoxy group, an aryl group, an aryloxy group, a carbonyl group, a sulfonyl group, a carboxyl group, an alkoxycarbonyl group, a carbamyl group, a sulfone group, a sulfamyl group, a sulfonamide group, an acylamide group, a ureido group, or an amino group; $Y_2$ is the same as defined in formula (III).

Preferred yellow couplers are described in U.S. Pat. Nos. 2,778,658; 2,875,057; 2,908,573; 3,227,155; 3,227,550; 3,253,924; 3,265,506; 3,277,155; 3,341,331; 3,369,895; 3,384,657; 3,408,194; 3,415,652; 3,447,928;

3,551,155; 3,582,322; 3,725,072; and 3,894,875; German patent application (OLS) Nos. 1,547,868; 2,057,941; 2,162,899; 2,163,812; 2,213,461; 2,219,917; 2,261,361 and 2,263,875; Japanese Patent Publication No. 13,576/74; Japanese patent application (OPI) Nos. 29,432/73; 66,834/73; 10,736/74 and 122,335/74; 28,834/75 and 132,926/75 (the symbol OPI means an unexamined published Japanese patent application).

Preferred magenta couplers are those having formula (IV):

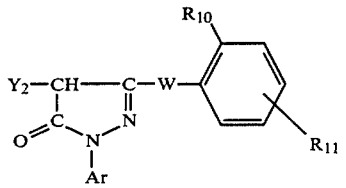

(IV)

wherein Ar is an aryl group; $R_{10}$ is a hydrogen atom, a halogen atom, an alkyl group or an alkoxy group; $R_{11}$ is an alkyl group, an amide group, an imido group, an N-alkylcarbamoyl group, an N-alkylsulfamoyl group, an alkoxycarbonyl group, an acyloxy group, a sulfonamide group or a urethane group; Y is the same as defined in formula (III); W is an amino group, a carbonyl amino group or a ureido group.

Preferred magenta couplers are described in U.S. Pat. Nos. 2,600,788; 3,061,432; 3.062,653; 3,127,269; 3,311,476; 3,152,896; 3,419,391; 3,519,429; 3,558,318; 3,684,514; 3,888,680; 3,907,571; 3,928,044; 3,930,861; 3,930,866 and 3,933,500; Japanese patent application (OPI) Nos. 29,639/74; 111,631/74; 129,538/74; 13,041/75; 58,922/75; 62,454/80; 118,034/80 and 38,043/81; British Pat. No. 1,247,493; Belgian Pat. Nos. 769,116 and 792,525; German Pat. No. 2,156,111; and Japanese Patent Publication No. 60,479/71.

Preferred cyan couplers are those having formula (V):

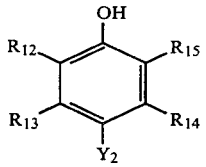

(V)

wherein $Y_2$ is the same as defined in formula (III); $R_{12}$, $R_{13}$, $R_{14}$ and $R_{15}$ are each a hydrogen atom, a halogen atom, an alkyl group, a carbamoyl group, a sulfamoyl group, an amide group, a sulfonamide group, a phosphamide group or a ureido group.

Preferred cyan couplers are described in U.S. Pat. Nos. 2,369,929; 2,423,730; 2,434,272; 2,474,293; 2,698,794; 2,706,684; 2,772,162; 2,801,171; 2,895,826; 2,908,573; 3,034,892; 3,046,129; 3,227,550; 3,253,294; 3,311,476; 3,386,301; 3,419,390; 3,458,315; 3,476,563; 3,516,831; 3,560,212; 3,582,322; 3,583,971; 3,591,383; 3,619,196; 3,632,347; 3,652,286; 3,737,326; 3,758,308; 3,779,763; 3,839,044 and 3,880,661; German patent application (OLS) Nos. 2,163,811; 2,207,468; Japanese Patent Publication Nos. 27,563/64 and 28,836/70; Japanese patent application (OPI) Nos. 37,425/72; 10,135/75; 25,228/75; 112,038/75; 117,422/75; 130,441/75; 109,630/78; 65,134/81 and 99,341/81; and Research Disclosure, No. 14,853 (1976).

Typical examples of the dye image forming couplers that may be used in the present invention are listed below, but it should be understood that they are given for illustrative purposes only.

Yellow couplers (Y-1)
α-benzoyl-2-chloro-5-[α-(dodecyloxycarbonyl)ethoxycarbonyl]-acetanilide
(Y-2)
α-benzoyl-2-chloro-5-[γ(2,4-di-t-amylphenoxy)-butylamide]-acetanilide
(Y-3)
α-fluoro-α-pivalyl-2-chloro-5-[γ-(2,4-di-t-amylphenoxy)butylamide]-acetanilide
(Y-4)
α-pivalyl-α-stearoyloxy-4-sulfamoyl-acetanilide
(Y-5)
α-pivalyl-α-[4-(4-benzyloxyphenylsulfonyl)phenoxy-2-chloro-5-[γ-(2,4-di-t-amylphenoxy)butylamide]-acetanilide
(Y-6)
α-(2-methoxybenzoyl)-α-(4-acetoxyphenoxy)-4-chloro-2-(4-t-octylphenoxy)-acetanilide
(Y-7)
α-pivalyl -α-(3,3-dipropyl-2,4-dioxo-azetizine-1-yl)-2-chloro-5-[α-(dodecyloxycarbonyl)ethoxycarbony]-acetanilide
(Y-8)
α-pivalyl-α-succinimide-2-chloro-5-[γ-(2,4-di-t-amylphenoxy)-butylamide]acetanilide
(Y-9)
α-pivalyl-α-(3-tetradecyl-1-succinimide)acetanilide
(Y-10)
α-(4-dodecyloxybenzoyl)-α-(5-methoxy-1-succinimide)-3,5-dicarboxyacetanilide-dipotassium salt
(Y-11)
α-pivalyl-α-phthalimide-2-chloro-5-[γ-(2,4-di-t-amylphenoxy)-butylamide]-acetanilide
(Y-12)
α-2-furyl-α-phthalimide-2-chloro-5-[γ-(2,4-di-t-amylphenoxy)-butylamide]-acetanilide
(Y-13)
α-3-[α-(2,4-di-t-amylphenoxy)-butylamide]-benzoyl]-α-succinimide-2-methoxyacetanilide
(Y-14)
α-phthalimide-α-pivalyl-2-methoxy-4-[(N-methyl-N-octadecyl)-sulfamoyl]-acetanilide
(Y-15)
α-acetyl-α-succinimide-2-methoxy-4-[(N-methyl-N-octadecyl)-sulfamoyl]-acetanilide
(Y-16)
α-cyclobutylyl-α-(3-methyl-3-ethyl-1-succinimide)- 2-chloro-5-[(2,5-di-t-amylphenoxy)-acetamide]-acetamilide
(Y-17)
α-(3-octadecyl-1-succinimide)-α-propanoylacetanilide
(Y-18)
α-(2,6-dioxo-3-n-propyl-piperidine-1-yl)-α-pivalyl-2-chloro-5-[γ-(2,4-di-t-amylphenoxy)butylcarbamoyl]-acetanilide
(Y-19)
α-(1-benzyl-2,4-dioxo-imidazolidine-3-yl)-α-pivalyl-2-chloro-5-[γ-2,4-di-t-amylphenoxy)butylamide]-acetanilide
(Y-20)

α-(1-benzyl-2-phenyl-3,5-dioxo-1,2,4-triazine-4-yl)-α-pivalyl-2-chloro-5-[γ-(2,4-di-t-amylphenoxy)-butylamide]-acetanilide
(Y-21)
α-(3,3-dimethyl-1-succinimide)-α-pivalyl-2-chloro-5-[α-(2,4-di-t-amylphenoxy)-butylamide]-acetanilide
(Y-22)
α-[3-(p-chlorophenyl)-4,4-dimethyl-2,5-dioxo-1-imidazolyl]-α-pivalyl-2-chloro-5[γ-(2,4-di-t-amylphenoxy)-butylamide]-acetanilide
(Y-23)
α-pivalyl-α-(2,5-dioxo-1,3,4-triazine-1-yl)-2-methoxy-5-[α-(2,4-di-t-amylphenoxy)-butylamide]-acetanilide
(Y-24)
α-(5-benzyl-2,4-dioxo-3-oxazolyl)-α-pivalyl-2-chloro-5-[γ-(2,4-di-t-amylphenoxy)-butylamide]-acetanilide
(Y-25)
α-(5,5-dimethyl-2,4-dioxo-3-oxazolyl)-α-pivalyl-2-chloro-5-[α-(2,4-di-t-amylphenoxy)butylamide]-acetanilide
(Y-26)
α-(3,5-dioxo-4-oxadinyl)-α-pivalyl-2-chloro-5-[γ-(2,4-di-t-amylphenoxy)-butylamide]-acetanilide
(Y-27)
α-pivalyl-α-(2,4-dioxo-5-methyl-3-thiazolyl)-2-chloro-5-[γ-(2,4-di-t-amilphenoxy)-butylamide]-acetanilide
(Y-28)
α-[3(2H)-pyridazone-2-yl]-α-pivalyl-2-chloro-5-[γ-(2,4-di-t-amylphenoxy)-butylamide]-acetanilide
(Y-29)
α-[4,5-dichlo-3(2H)-pyridazone-2-yl]-α-benzoyl-2-chloro-5-[α-(dodecyloxycarbonyl)-ethoxycarbonyl]-acetanilide
(Y-30)
α-(1-phenyl-tetrazol-5-oxy)-α-pivalyl-2-chloro-5-[γ-(2,4-di-t-amylphenoxy)-butylamide]-acetanilide
(Y-31)
4,4'-di-(acetacetamino)-3,3'-dimethyldiphenylmethane
(Y-32)
P,P'-di-(acetacetamino)-diphenylmethane Magenta couplers (M-1)
1-(2,4,6-trichlorophenyl)-3-(2-chloro-5-octadecylcarbamoyl-anilino)-5-pyrazolone
(M-2)
1-(2,4,6-trichlorophenyl)-3-(2-chloro-5-tetradecaneamide-anilino)-5-pyrazolone
(M-3)
1-(2,4,6-trichlorophenyl)-3-[2-chloro-5-γ-(2,4-di-t-amylphenoxy)-butylcarbamoyl]-anilino-5-pyrazolone
(M-4)
1-(2,4,6-trichlorophenyl)-4-chloro-3-[2-chloro-5-γ-(2,4-di-t-amylphenoxy)-butylcarbamoyl]-anilino-5-pyrazolone
(M-5)
1-(2,4,6-trichlorophenyl)-4-diphenylmethyl-3-[2-chloro-5-(γ-octadecenylsuccinimide)propylsulfamoyl]-anilino-5-pyrazolone
(M-6)
1-(2,4,6-trichlorophenyl)-4-acetoxy-5-(2-chloro-5-tetradecanamide)-anilino-5-pyrazolone
(M-7)
1-[γ-(3-pentadecylphenoxy)-butylamide]-phenyl-3-anilino-4-(1-phenyl-tetrazole-5-thio)-5 pyrazolone
(M-8)
1-(2,4,6-trichlorophenyl)-3-(2-chloro-5-octadecylsuccinimide)-anilino-5-pyrazolone
(M-9)
1-(2,4,6-trichlorophenyl)-3-(2-chloro-5-octadecenylsuccinimide)-anilino-5-pyrazolone
(M-10)
1-(2,4,6-trichlorophenyl)-3-[2-chloro-5-(N-phenyl-N-octylcarbamoyl)]-anilino-5-pyrazolone
(M-11)
1-(2,4,6-trichlorophenyl)-3-[2-chloro-5-(N-butylcarbonyl)-pyrazynylcarbonyl]-anilino-5-pyrazolone
(M-12)
1-(2,4,6-trichlorophenyl)-3-[2-chloro-5-{(2,4-di-carboxy-5-phenylcarbamoyl)-benzylamide]}-anilino-5-pyrazolone
(M-13)
1-(2,4,6-trichlorophenyl)-3-(4-tetradecylthiomethylsuccinimide)-anilino-5-pyrazolone
(M-14)
1-(2,4,6-trichlorophenyl)-3-[2-chloro-4-(2-benzofuryl-carboxyamide)]-anilino-5-pyrazolone
(M-15)
1-(2,4,6-trichlorophenyl) -3-{2-chloro-4-[γ-(2,2-dimethyl-6-octadecyl-7-hydroxy-chroman-4-yl)propionamide]}-anilino-5-pyrazolone
(M-16)
1-(2,4,6-trichlorophenyl)-3-[2-chloro-5-(3-pentadecylphenyl)-phenylcarbonylamide]-anilino5-pyrazolone
(M-17)
1-(2,4,6-trichlorophenyl)-3-{2-chloro-5-[(3-t-butyl-4-hydroxyphenoxy)-tetradecanamide]-anilino}-5-pyrazolone
(M-18)
1-(2,6-dichloro-4-methoxyphenyl)-3-(2-methyl-5-tetradecanamide)-anilino-5-pyrazolone
(M-19)
4,4'-benzylidenebis[1-(2,4,6-trichlorophenyl)-3-{2-chloro-4-[γ-(2,4-di-t-amylphenoxy)-butylamide]anilino}-5-pyrazolone]
(M-20)
4,4'-benzylidenebis[1-(2,3,4,5,6-pentachlorophenyl)-3-{2-chloro-5-[γ-(2,4,-di-t-amylphenoxy)butylamide]-anilino-5-pyrazolone]
(M-21)
4,4'-(2-chloro)benzylidenebis[1-(2,4,6-trichlorophenyl)-3-(2-chloro-5-dodecylsuccinimide)-anilino-5-pyrazolone
(M-22)
4,4'-benzylidenebis[2-(2-chlorophenyl)-3-(2-methoxy-4-hexadecanamide)-anilino-5-pyrazolone]
(M-23)
4,4'-methylenebis[1-(2,4,6-trichlorophenyl)-3-(2-chloro-5-dodecenylsuccinimide)-anilino-5-pyrazolone)]
(M-24)
1-(2,4,6-trichlorophenyl)-3-[3-(2,4-di-t-amylphenoxyacetoamide)benzamide]-5-pyrazolone
(M-25)
3-ethoxy-1-{4-[α-(3-pentadecylphenoxy)butylamide]-phenyl}-5-pyrazolone
(M-26)
1-(2,4,6-trichlorophenyl)-3-[2-chloro-5-{α-(3-t-butyl-4-hydroxy)-phenyl}-tetradecanamide]anilino-5-pyrazolone
(M-27)
1-(2,4,6-trichlorophenyl)-3-(3-nitroanilino)-5-pyrazolone Cyan couplers (C-1)
2-[α-(4-t-butylphenoxy)-butylamide]-phenol (C-2)
2-[α-(4-t-amylphenoxy)-butylamide]-5-methylphenol
(C-3)
2-chloro-6-[α-(2,4-di-t-amylphenoxy)-butylamide]-phenol
(C-4)
2-phenyl-6-[α-(4-t-amylphenoxy)-butylamide]phenol
(C-5)
2,4-dichloro-3-methyl-6-(di-t-amylphenoxyacetamide)-phenol
(C-6)
2,4-dichloro-3-methyl-6-[α-(2,4-di-t-amylphenoxy)-butylamide]-phenol
(C-7)
2-chloro-3-methyl-4-ethylcarbamoylmethoxy-6[α-(2,4-di-t-amylphenoxy)-butylamide]-phenol
(C-8)
2-chloro-3-methyl-4-propionyloxy-6-[α-(2,4-di-t-amylphenoxy)-acetamide]-phenol
(C-9)
2-chloro-3-methyl-4-fluoro-6-[α-(2,4-di-t-amylphenoxy)-butylamide]-phenol
(C-10)
2-chloro-3-methyl-4-(1-phenyl-tetrazolyl-5-thio)-6-(2-dodecyloxyphenylacetamide)-phenol
(C-11)
2,4-difluoro-3-methyl-6-[α-(3-t-butyl-4-hydroxyphenoxy)-tetradecanamide]-phenol
(C-12)
2-(α,α,β,β-tetrafluoropropylamide)-4-acetoxy-6(2,4-di-t-butylphenoxy)acetylamide-phenol
(C-13)
2,4-difluoro-3-methyl-6-[α-(2,4-di-t-amylphenoxy)-butylamide]-phenol
(C-14)
2-perfluorobutylamide-5-[α-(2,4,-di-t-amylphenoxy)-hexanamide]-phenol
(C-15)
2-(α,α,β,β-tetrafluoropropionamide)-5-[α-(2,4-di-t-amylphenoxy)-butylamide]-phenol
(C-16)
2-(α,α,β,β-tetrafluoropropionamide)-4-β-chloroethoxy-5-[α-(2,4-di-t-amylphenoxy)butylamide]-phenol
(C-17)
2-(α,α,β,β,γ,γ,δ,δ-octafluoropentanamide)-5-[α-(2,4-di-t-amylphenoxy)-butylamide]-phenol
(C-18)
2-(4-t-amyl-3-phenoxybenzoylamino)-3,5-dimethylphenol
(C-19)
1-hydroxy-N-[δ-(2,4-di-t-amylphenoxy)butyl]-2-naphthamide
(C-20)
1-hydroxy-4-(isopropylcarbamoyl)methoxy-N-[δ-(2,4-di-t-amylphenoxy)-butyl-2-naphthamide
(C-21)
1-hydroxy-4-[β-(methoxyethyl)carbamoyl]-methoxy-N-dodecyl-2-naphthamide
(C-22)
1-hydroxy-4-(p-nitrophenylcarbamoyl)oxy-N-(δ-(2,4-di-t-amylphenoxy)butyl]-2-naphthamide
(C-23)
1-hydroxy-N-dodecyl-2-naphthamide
(C-24)
1-hydroxy-4-(4-nitrophenoxy)-N-[δ-(2,4-di-t-amylphenoxy)butyl]-2-naphthamide
(C-25)
1-hydroxy-4-(1-phenyl-5-tetrazolyloxy)-N-[δ-(2,4-di-t-amylphenoxy)butyl]-2-naphthamide
(C-26)
5-(p-amylphenoxybenzensulfonamino)-1-naphthol
(C-27)
5-(N-benzyl-N-naphthalensulfonamino)-1-naphthol
(C-28)
2-chloro-5-(p-nitrobenzoyl-B-O-hydroxyethylamino)-1-naphthol
(C-29)
5-(1,2,3,4-tetrahydronaphthalene-6-sulfamide)-1-naphthol
(C-30)
5-(quinoline-5-sulfamide)-1-naphthol
(C-31)
1-hydroxy-4-acetoxy-N-[α-(2,4-di-t-amylphenoxy)butyl-2-naphthamide
(C-32)
1-hydroxy-4-thiocyano-N-[α-(2,4-di-t-amylphenoxy)-butyl]-2-naphthamide
(C-33)
1-hydroxy-4-(pentafluorophenoxy)-N-{β-{4-[α-(2,4-di-t-amylphenoxy)acetamide]-phenyl}-ethyl}-2-naphthamide
(C-34)
1-hydroxy-4-(4-chlorophenoxy)-2-tetradecyloxy-2-naphthamide
(C-35)
1-hydroxy-4-phthalimide-N-[α-(2,4-di-t-amylphenoxy)-butyl-2-naphthamide
(C-36)
1-hydroxy-4-(dodecenylsuccinimide)-N-[δ-(2,4-di-t-amylphenoxy)butyl]-2-naphthamide
(C-37)
1-hydroxy-4-phenylthio-N-[α-(2,4-di-t-amylphenoxy)-butyl]-2-naphthamide Any conventional color developing agent may be used to develop the couplers that are incorporated in the color photographic product of the present invention to form dye images. Useful color developing agents are aromatic primary amine compounds such as primary phenylenediamines, aminophenols and derivatives thereof. Typical examples are: N,N-dimethyl-p-phenylenediamine, N,N-diethyl-p-phenylenediamine, N-carbamidomethyl-N-methyl-p-phenylenediamine, N-carbamidomethyl-N-tetrahydrofurfuryl-2-methyl-p-phenylenediamine, N-ethyl-N-carboxymethyl-2-methyl-p-phenylenediamine, N-carbamidomethyl-N-ethyl-2-methyl-p-phenylenediamine, N-ethyl-N-tetrahydrofurfuryl-2-methyl-p-aminophenol, 3-acetyl-amino-4-aminodimethylaniline, N-ethyl-N-β-methanesulfonamidoethyl-4-aminoaniline, N-ethyl-N-β-methanesulfonamidoethyl-3-methyl-4-aminoaniline, N-methyl-N-β-sulfoethyl-p-phenylenediamine, o-aminophenol, p-aminophenol, 5-amino-2-oxy-toluene, as well as salts thereof with inorganic acids (e.g. hydrochloric acid and sulfuric acid) or organic acids (e.g. p-toluenesulfonic acid).

By incorporating the compounds of formula (I) or (II) in the color photographic product, cyan, magenta and yellow dyes having a markedly high resistance to light fading can be produced from the respective dye image forming couplers. As another advantage, cyan dyes resistant to dark fading can also be prepared. The compounds of formula (I) or (II) prove particularly effective in preventing the light fading of yellow dyes when they are incorporated in proximity with the yellow dyes.

The compounds of formula (I) or (II) can be used in combination with conventional anti-fading agents in order to prolong the effectiveness of these agents. The compounds may also be used in combination with UV absorbers such as 2-(2'-hydroxyphenyl)benzotriazole compounds in order to extend their effectiveness.

In a particularly preferred embodiment, the compounds of formula (I) or (II) may be incorporated in silver halide photographic materials. To be more specific, these compounds may be incorporated in at least one of the photographic emulsion layers that form cyan, magenta and yellow dyes upon color development. Alternatively, the compounds may be incorporated in other silver halide color photographic elements such as intermediate layers, yellow filter layers and UV absorbing layers. The compounds may also be incorporated in the photographic material during development or in the color photographic product obtained by development.

Particularly great effects are attained by incorporating the compounds of formula (I) or (II) in one of the layers that contain dyes produced from the couplers used in the present invention. Equally good results are obtained if these compounds are diffused into the dye containing layer from another photographic element, typically an adjoining or an adjacent layer.

One useful technique of incorporating these compounds in a silver halide photographic material comprises first dissolving them in a high-boiling organic solvent (ca. 175° C. or higher), optionally together with a low-boiling solvent, putting the solution into an aqueous binder such as an aqueous solution of gelatin so as to finely disperse the compounds in the binder with the aid of a surfactant, and finally adding the dispersion to a particular hydrophilic colloidal layer. A desired coupler may be dispersed in the aqueous binder together with the solution containing the compounds of formula (I) or (II). The method of incorporating these compounds in a silver halide color photographic material is hereunder described in detail: first, the compounds, together with hydrophobic additives (e.g. couplers, UV absorbers, antifading agents, brightening agents, and hydroquinone derivatives) are dissolved in high-boiling solvents such as organic acid amides, carbamates, esters, ketones and urea derivatives, particularly, di-n-butyl phthalate, tri-cresyl phosphate, di-isooctyl acetate, di-n-butyl sebacate, tri-n-hexylphosphate, N,N-di-ethyl-caprylamidobutyl, n-pentadecylphenyl ether, triphenyl phosphate, di-octyl phthalate, n-nonyl phenol, N,N-diethyl laurylamide, 3-pentadecyl phenylethyl ether, 2,5-di-sec-amylphenylbutyl ether, monophenyl-di-o-chlorophenyl phosphate and fluorinated paraffin, optionally in combination with low-boiling solvents such as methyl acetate, ethyl acetate, propyl acetate, butyl acetate, butyl propionate, cyclohexanol, cyclohexane tetrahydrofuran, methyl alcohol, ethyl alcohol, acetonitrile, dimethylformamide, dioxane, methyl ethyl ketone, methyl isobutyl ketone, diethylene glycol monoacetate, acetylacetone, nitromethane, nitroethane, carbon tetrachloride and chloroform (the high-boiling solvents may be used individually or in mixture, and so are the low-boiling solvents.) The resulting solvent is mixed with an aqueous solution of a hydrophilic binder such as gelatin in the presence of an anionic surfactant such as alkylbenzenesulfonic acid or alkylnaphthalenesulfonic acid and/or a nonionic surfactant such as sorbitan sesquioleate or sorbitan monolaurate, and the mixture is emulsified with a high-speed mixer, a colloid mill or an ultrasonic homogenizer. The so prepared emulsion is then added to a particular hydrophilic colloidal layer.

The compounds of formula (I) or (II) are substantially colorless and will have no adverse effects on the dye image such as color contamination, so there is no particular limitation on the amount of these compounds to be incorporated in the photographic material. Primarily for economical reasons, if the color photographic material contains a coupler, these compounds are preferably used in an amount of 5 to 300 wt %, more preferably in an amount of 10 to 100 wt %, on the basis of the coupler. For photographic materials containing no coupler, the compounds are preferably used in an amount of 10 to 100 g, more preferably from 15 to 60 g, per mol of the silver halide. If the compounds are used in combination with a UV absorber such as 2-(2'-hydroxyphenyl)benzotriazole compound, the preferred amount is from 1 to 400 wt %, with the 5 to 200 wt % range being particularly preferred.

The compounds of formula (I) or (II) may be used either alone or in combination with themselves, and in the latter case, the sum of the individual compounds may satisfy the above requirements on their amount of addition.

If the couplers are to be incorporated in a silver halide color photographic material, they are preferably used in an amount of 5 to 50 mol %, more preferably from 10 to 40 mol %, per mol of the silver halide. If they are incorporated in a developing solution, they are preferably employed in an amount of 0.5 to 3.0 g/liter, more preferably from 1.0 to 2.0 g/liter. Yellow, magenta or cyan couplers may be used individually or in combination with themselves, and in the latter case, the sum of the individual couplers may satisfy the above requirements for the amount of their addition.

The silver halide color photographic material according to the present invention may contain special couplers other than the yellow, magenta and cyan couplers listed above. One example of such special couplers is a colored magenta coupler. Photographic emulsion layers or adjoining or adjacent layers may contain couplers that release a development inhibitor depending upon the image density during development, or other development-inhibitor-releasing compounds.

The compounds of formula (I) or (II) may be used in combination with UV absorbers such as thiazoline, benzotriazole, acrylonitrile and benzophenone compounds, and this is preferred because the fading due to actinic radiation of short wavelengths can be effectively prevented. Particularly preferred UV absorbers are Tinuvin PS, 320, 326, 327 and 328 of Ciba-Geigy Corporation, which may be used independently or in combination.

It is also effective to use the compounds of formula (I) or (II) in combination with hydroquinone derivatives (antioxidants). Illustrative hydroquinone derivatives are listed below:

Hq-1
2,5-di-t-octylhydroquinone
Hq-2
2-t-octyl-5-methylhydroquinone
Hq-3
2,6-di-n-dodecylhydroquinone
Hq-4
2-n-dodecylhydroquinone
Hq-5
2,2'-methylenebis-5,5'-di-t-butylhydroquinone Hq-6
2,5-di-n-octylhydroquinone
Hq-7
2-dodecylcarbamoylmethylhydroquinone
Hq-8
2-(β-n-dodecyloxycarbonyl)ethyl-hydroquinone
Hq-9
2-(N,N-dibutylcarbamoyl)hydroquinone
Hq-10
2-n-dodecyl-5-chloro-hydroquinone
Hq-11
2-(2-octadecyl)-5-methylhydroquinone
Hq-12
2,5-di-(p-methoxyphenyl)hydroquinone
Hq-13
2-t-octylhydroquinone
Hq-14
2-[β-{3-(3-sulfobenzamide)benzamide}ethylhydroquinone
Hq-15
2,5-dichloro-3,6-diphenylhydroquinone
Hq-16
2,6-dimethyl-3-t-octylhydroquinone
Hq-17
2,3-dimethyl-5-t-octylhydroquinone
Hq-18
2-{β-(dodecanoyloxy)ethyl}carbamoylhydroquinone
Hq-19
2-dodecyloxycarbonylhydroquinone
Hq-20
2-{β-(4-octanamidephenyl)ethyl}hydroquinone
Hq-21
2-methyl-5-dodecylhydroquinone These hydroquinone derivatives are used either independently or in combination. For silver halide color photographic materials containing couplers, these derivatives are preferably used in an amount of 0.01 to 10 mols, more preferably from 0.1 to 3 mols, per mol of the coupler. For photographic materials containing no coupler, the derivatives are preferably used in an amount of 0.01 to 1.0 mol, more preferably from 0.02 to 0.6 mol, per mol of the silver halide.

The silver halide emulsions used in the color photographic material according to the present invention are generally prepared by dispersing silver halide grains in hydrophilic colloids. Illustrative silver halides are silver chloride, silver bromide, silver iodide, silver chlorobromide, silver iodobromide, silver chloroiodobromide and mixtures thereof. These silver halides may be prepared by known methods such as the ammoniacal method, neutral method, "conversion" method and double-jet method. Hydrophilic colloids commonly employed to disperse these silver halides include gelatin and gelatin derivatives such as phthalated and malonated gelatins. Part or all of the gelatin or gelatin derivatives may be replaced by alubumin, agar, gum arabic, alginic acid, casein, partially hydrolyzed cellulose derivatives, partially hydrolyzed polyvinyl acetate, polyacrylamide, imidated polyacrylamide, polyvinylpyrrolidone, and copolymers of these vinyl compounds.

The silver halide emulsions used in the present invention may be optically sensitized with dyes that make them sensitive to the desired wavelength region. Suitable sensitizing dyes are cyanine dyes, merocyanine dyes and complex cyanine dyes, which may be used independently or in combination. If necessary, the silver halide emulsions may be used in combination with various photographic addenda which include chemical sensitizers such as salts of noble metals (e.g. gold, platinum, palladium, iridium, rhodium and ruthenium), sulfur compounds, reducing compounds, thioether compounds, quaternary ammonium salts and polyalkylene oxides; stabilizers such as triazoles, imidazoles, azaindenes, benzothiazoliums, zinc compounds, cadmium compounds and mercaptans; hardeners such as chromium salts, zirconium salts, mucochloric acid, aldehydes, triazines, polyepoxy compounds, activated halogen compounds, ketone compounds, acryloyls, triethylene phosphamides and ethyleneimines; plasticizers such as glycerine and dihydroxyalkanes such as 1,5-pentanediol; brighteners; antistatic agents; coating aids. These photographic addenda may be used either alone or in combination.

The specific silver halide emulsion layer is prepared by coating the dispersion containing the compounds of formula (I) or (II). If necessary, these compounds may be incorporated in one or more of a subbing layer, an anti-halation layer, an intermediate layer, a yellow filter layer, a UV absorbing layer and a protective layer. These layers are coated onto a suitable support selected from among films of synthetic resins (e.g. cellulose acetate, cellulose nitrate, polycarbonates, polyethylene terephthalates and polystyrenes), baryta paper, polyethylene-coated paper and glass sheets.

The resulting silver halide color photographic material may be of coupler-in-emulsion type or coupler-in-developer type, and the coupler-in-emulsion type is preferred. After exposure, the color photographic material is processed by a conventional color developing technique. Other suitable silver halide color photographic materials are those wherein the coupler and the color developing agent incorporated in the same layer remain separate from each other before exposure and are brought into contact after exposure, or coupler-containing photographic materials wherein the color developing agent is contained in a coupler-free layer and is caused to move into contact with the coupler upon penetration by an alkaline processing solution. With photographic materials for processing by the diffusion transfer process, the compounds of formula (I) or (II) may be incorporated in photosensitive elements and/or image receiving elements, preferably in image receiving elements. The color photographic material according to the present invention may be processed by the reversal process which comprises (1) black-and-white development, (2) exposure to white light or processing in a bath containing an antifoggant such as a boron compound, (3) color development with an alkaline solution containing a suitable color developing agent, optionally together with an antifoggant, (4) bleaching with a bath containing ferricyanide or ferric salts of aminopolycarboxylic acid; (5) fixing with a bath containing a silver salt solvent such as thiosulfate so as to remove the silver image and residual silver halide, leaving only the desired dye image. The bleaching and fixing steps may be accomplished simultaneously by a blixing bath containing both an oxidizing agent such as a ferric salt of aminopolycarboxylic acid and a silver salt solvent such as thiosulfate. The color development, bleaching, fixing or blixing may be combined with any of the steps such as prehardening, neutralization, waching, stopping and stabilization. A process by which the silver halide color photographic containing the compounds of formula (I) or (II) can be advantageously processed comprises color development, optional washing, blixing, washing, optional stabilization, and drying. The entire process is carried out at elevated temperatures (30° C. or more) within a very short period of time.

Aside from the color developing agents described above, the color developer may optionally contain suitable additives such as alkali agents (e.g. hydroxides, carbonates or phosphates of alkali metals or ammonium), buffers (e.g. acetic acid or boric acid), pH control agents, development accelerators, anti-foggants, anti-stain or anti-sludge agents, interlayer effect accelerating agents, and preservatives.

Suitable bleaching agents include ferricyanides such as potassium ferricyanide, bichromates, permanganates, hydrogen peroxide, bleaching powder, metal complex salts of aminopolycarboxylic acids such as ethylenediaminetetraacetic acid, nitrilotriacetic acid and iminodiacetic acid, metal complex salts of polycarboxylic acids such as malonic acid, tartaric acid and malic acid, and ferric chloride. These bleaching agents may be used either independently or in combination. The bleaching bath may contain a bleach accelerator or any other suitable additive.

Suitable fixers include thiosulfates such as sodium thiosulfate, ammonium thiosulfate and cyanide urea derivatives. The fixing process may optionally contain a fix accelerator or any other suitable additive.

The silver halide color photographic material containing the compounds of formula (I) or (II) may be effectively processed by a color developing solution both containing a primary aromatic amine base color developing agent and an oxidizing agent that brings a metallic silver image into the redox reaction. Upon development with this solution, the color developing agent is oxidized by the oxidizing agent, and the oxidized color developing agent couples with a specific photographic coupler to form a dye image. An example of this color developing solution is described in Japanese Patent Application (OPI) No. 9729/73. A preferred oxidizing agent is a cobalt complex salt having a coordination number of 6. Photographic processing using this type of color developing solution is particularly adaptive to color photographic materials containing less silver than ordinary silver halide color photographic materials.

The silver halide color photographic material containing the compounds of formula (I) or (II) may also advantageously be processed by a technique which consists of development in a color developing bath containing a primary aromatic amine base color developing agent, and contact with an amplifying bath containing an oxidizing agent (which brings the metallic silver image into redox reaction) such as a cobalt complex salt having a coordination number of 6 in the presentce of a color developing agent that is received by a photosensitive layer and moved into the amplifying bath. The contact with the amplifying bath may be effected either after or during the color development, and contact during the color development step is preferred. Another oxidizing agent that is preferred for this technique is aqueous hydrogen peroxide.

The present invention is hereunder described in greater detail by reference to the following examples which are given here for illustrative purposes only and are by no means intended to limit its scope.

EXAMPLE 1

Nine samples of silver halide color photographic material having the basic formulation indicated in Table 1 were prepared.

TABLE 1

| | | Silver coating (mg/100 cm$^2$) | Gelatin coating (mg/100 cm$^2$) | Coupler dispersion |
|---|---|---|---|---|
| Layer 2 | Protective layer | — | 20 | — |
| Layer 1 | Blue-sensitive emulsion layer | 4.0 | 25 | See Table 2. |
| Polyethylene-coated paper as a support | | | | |

| Sample No. | Coupler and its amount (g) | Anti-fading agent and its amount (g) | Hydroquinone derivative and its amount (g) | High-boiling organic solvent and its amount (ml) | Low-boiling organic solvent, and its amount (ml) | Remarks |
|---|---|---|---|---|---|---|
| 1 | (Y - 1) 31 | — | (Hq - 1) 0.6 | DBP 31 | EA 62 | Comparative |
| 2 | " | (1) 10 | " | " | " | According to the present invention |
| 3 | (Y - 5) 33 | — | " | " | " | Comparative |
| 4 | " | (1) 10 | " | " | " | According to the present invention |
| 5 | (Y - 19) 38 | — | " | DOP 33 | " | Comparative |
| 6 | " | (1) 10 | " | " | " | According to the present invention |
| 7 | " | (2) 10 | (Hq - 21) 0.5 | " | " | According to the present invention |
| 8 | (Y - 25) 36 | — | (Hq - 1) 0.6 | TOP 36 | " | Comparative |
| 9 | " | (1) 10 | " | " | " | According to the present invention |

In Table 2, DBP, DOP, TOP and EA indicate dibutyl phthalate, di-2-ethylhexyl phthalate, tri-2-ethylhexyl phosphate, and ethyl acetate, respectively.

The nine samples thus prepared were exposed to white light through an optical wedge on a sensitometer, Model KS-7 of Konishiroku Photo Industry Co., Ltd. The exposed samples were processed by the following procedure.

| Processing steps | Time (min) | Temp. (°C.) |
|---|---|---|
| Color development | 3.5 | 33 |
| Blixing | 1.5 | 33 |

-continued

| Processing steps | Time (min) | Temp. (°C.) |
|---|---|---|
| Washing | 3.0 | 33 |
| Drying | — | 80 |

| Formulation of the color developer | |
|---|---|
| Pure water | 700 ml |
| Benzyl alcohol | 15 ml |
| Diethylene glycol | 15 ml |
| Hydroxylamine sulfate | 2 g |
| N—ethyl-N—β-methanesulfonamidoethyl-3-methyl-4-aminoaniline sulfate | 4.4 g |
| Potassium carbonate | 30 g |
| Potassium bromide | 0.4 g |
| Potassium chloride | 0.5 g |
| Potassium sulfite | 2.0 g |
| Pure water to make | 1,000 ml (pH = 10.2) |

| Formulation of the blix bath | |
|---|---|
| Ethylenediaminetetraacetic acid iron ammonium salt | 61 g |
| Ethylenediaminetetraacetic acid diammonium salt | 5 g |
| Ammonium thiosulfate | 125 g |
| Sodium metabisulfite | 13 g |
| Sodium sulfite | 2.7 g |
| Water to make | 1,000 ml (pH = 7.2) |

The relative sensitivity and maximum reflection density of each sample were measured with a photoelectric densitometer, Model PDA-60 type of Konishiroku Photo Industry Co., Ltd. The results are shown in Table 3.

TABLE 3

| Sample No. | Relative sensitivity | Max. reflection density |
|---|---|---|
| 1 (Comparative) | 80 | 2.10 |
| 2 | 81 | 2.10 |
| 3 (Comparative) | 91 | 2.32 |
| 4 | 90 | 2.32 |
| 5 (Comparative) | 100 | 2.45 |
| 6 | 101 | 2.46 |
| 7 | 100 | 2.44 |
| 8 (Comparative) | 95 | 2.34 |
| 9 | 95 | 2.34 |

The above data shows that the compounds according to the present invention had no adverse effects on the photographic characteristics.

The respective samples were subjected to a light fading test, and the results are shown in Table 4, wherein the term "percent of residual dye" means percent of dye density after exposure to a xenon fadeometer, with the initial density (1.0) taken as 100%, and the "yellowing" means the difference between the density, as measured with blue light, of the white background before exposure to the fadeometer and that measured after the exposure.

TABLE 4

| | Xenon fadeometer (200 hrs) | | Sunlight (200 days) | |
|---|---|---|---|---|
| Sample No. | Percent of residual dye | Yellowing | Percent of residual dye | Yellowing |
| 1 (Comparative) | 33 | 0.04 | 48 | 0.05 |
| 2 | 52 | 0.02 | 67 | 0.03 |
| 3 (Comparative) | 65 | 0.03 | 59 | 0.04 |
| 4 | 81 | 0.02 | 72 | 0.03 |
| 5 (Comparative) | 61 | 0.03 | 56 | 0.04 |
| 6 | 79 | 0.02 | 74 | 0.03 |
| 7 | 80 | 0.02 | 76 | 0.03 |
| 8 (Comparative) | 45 | 0.03 | 50 | 0.04 |
| 9 | 72 | 0.02 | 71 | 0.03 |

The data in Table 4 shows that the samples of the present invention were much improved over the comparative samples with respect to the resistance of the yellow dyes to light fading and the yellowing of the white background.

EXAMPLE 2

Nine samples of silver halide color photographic material were prepared as in Example 1 except that the blue-sensitive emulsion layers were replaced by green-sensitive emulsion layers containing magenta couplers.

TABLE 5

| Sample No. | Coupler and its amount (g) | Anti-fading agent and its amount (g) | Comparative anti-fading agent and its amount (g) | Hydroquinone derivative and its amount (g) | High-boiling organic solvent and its amount (ml) | Low-boiling organic solvent and its amount (ml) | Remarks |
|---|---|---|---|---|---|---|---|
| 10 | (M - 1) 25 | — | — | (Hq - 1) 0.8 | TOP 25 | EA 63 | Comparative |
| 11 | " | — | (G - 1) 8 | " | " | " | Comparative |
| 12 | " | (1) 8 | — | " | " | " | According to the present invention |
| 13 | (M - 3) 25 | — | — | (Hq - 21) 0.8 | TCP 25 | " | Comparative |
| 14 | " | — | (G - 2) 8 | " | " | " | Comparative |
| 15 | " | (1) 8 | — | " | " | " | According to the present invention |
| 16 | (M - 9) 27 | — | — | (Hq - 1) 0.8 | TCP 25 | " | Comparative |
| 17 | " | — | (G - 3) 8 | " | " | " | Comparative |
| 18 | " | (1) 8 | — | " | " | " | According to the present invention |

Comparative anti-fading agent G-1

Compound of the following formula as described in Japanese Patent Publication No. 20977/65:

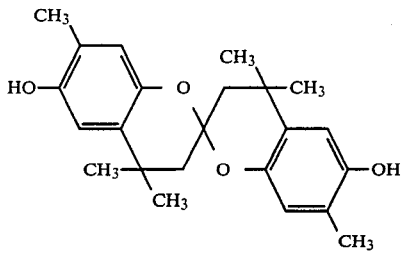

Comparative anti-fading agent G-2

Compound of the following formula as described in U.S. Pat. No. 3,432,300:

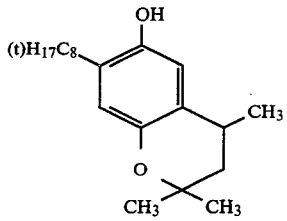

Comparative anti-fading agent G-3

Compound of the following formula as described in Japanese Patent Publication No. 31256/73:

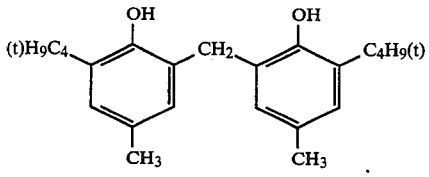

The respective samples were processed and measured for their relative sensitivity and maximum reflection density as in Example 1. The results are shown in Table 6. The samples of the present invention show little or no reduction in relative sensitivity and reflection density as compared with the comparative samples.

TABLE 6

| Sample No. | Relative sensitivity | Max. reflection density |
|---|---|---|
| 10 (Comparative) | 98 | 2.40 |
| 11 (Comparative) | 94 | 2.37 |
| 12 | 98 | 2.39 |
| 13 (Comparative) | 95 | 2.41 |
| 14 (Comparative) | 92 | 2.38 |
| 15 | 95 | 2.41 |
| 16 (Comparative) | 100 | 2.37 |
| 17 (Comparative) | 99 | 2.36 |
| 18 | 100 | 2.37 |

The samples were subjected to a light fading test as in Example 1, and the results are shown in Table 7.

TABLE 7

| | Xenon fadeometer (100 hrs.) | | Sunlight (10 days) | |
|---|---|---|---|---|
| Sample No. | Percent of residual dye | Yellowing | Percent of residual dye | Yellowing |
| 10 (Comparative) | 51 | 0.14 | 53 | 0.16 |
| 11 (Comparative) | 70 | 0.10 | 71 | 0.14 |
| 12 | 71 | 0.10 | 71 | 0.13 |
| 13 (Comparative) | 56 | 0.13 | 59 | 0.14 |
| 14 (Comparative) | 73 | 0.11 | 74 | 0.12 |
| 15 | 73 | 0.11 | 75 | 0.11 |
| 16 (Comparative) | 48 | 0.14 | 50 | 0.15 |
| 17 (Comparative) | 69 | 0.11 | 69 | 0.11 |
| 18 | 71 | 0.12 | 69 | 0.10 |

The above data shows that the compounds according to the present invention were effective not only in suppressing the fading of magenta dyes due to exposure to light but also in preventing the yellowing of the white background due to the photolysis of unreacted magenta couplers.

EXAMPLE 3

Nine samples of silver halide color photographic material were prepared as in Example 1 except that the blue-sensitive emulsion layers were replaced by red-sensitive emulsion layers containing cyan couplers. The compositions of the coupler dispersions used in preparing the red-sensitive emulsion layers are shown in Table 8.

TABLE 8

| Sample No. | Coupler and its amount (g) | Anti-fading agent and its amount (g) | Comparative anti-fading agent and its amount (g) | Hydroquinone derivative and its amount (g) | High-boiling organic solvent and its amount (ml) | Low-boiling organic solvent and its amount (ml) | Remarks |
|---|---|---|---|---|---|---|---|
| 19 | (C - 5) 21 | — | — | (Hq - 1) 0.3 | DBP 10 | EA 53 | Comparative |
| 20 | " | — | (R - 1) 7 | " | " | " | Comparative |
| 21 | " | (1) 7 | — | " | " | " | According to the present invention |
| 22 | (C - 6) 22 | — | — | " | DOP 11 | " | Comparative |
| 23 | " | — | (R - 2) 7 | " | " | " | Comparative |
| 24 | " | (1) 7 | — | " | " | " | According to the present invention |
| 25 | (C - 15) 26 | — | — | " | DOP 26 | " | Comparative |
| 26 | " | — | (R - 3) 7 | " | " | " | Comparative |
| 27 | " | (1) 7 | — | " | " | " | According to the present invention |

Comparative anti-fading agent R-1

Compound of the following formula as described in Japanese patent application (OPI) No. 151149/75:

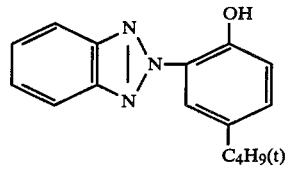

Comparative anti-fading agent R-2

Compound of the following formula as described in Japanese patent application (OPI) No. 15149/75:

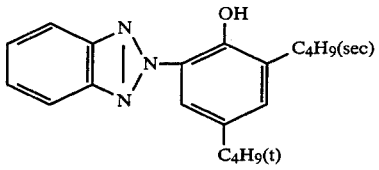

Comparative anti-fading agent R-3

Compound of the following formula as described in Japanese patent application (OPI) No. 48535/79:

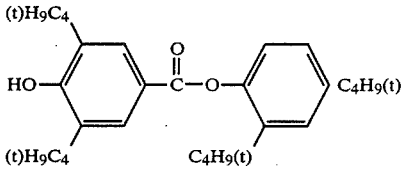

The respective samples were processed and measured for their relative sensitivity and maximum reflection density as in Example 1. The results are shown in Table 9. The samples of the present invention show little or no reduction in sensitivity and density as compared with the comparative samples.

TABLE 9

| Sample No. | Relative sensitivity | Max. reflection density |
|---|---|---|
| 19 (Comparative) | 100 | 2.31 |
| 20 (Comparative) | 94 | 2.15 |
| 21 | 98 | 2.28 |
| 22 (Comparative) | 100 | 2.33 |
| 23 (Comparative) | 92 | 2.14 |
| 24 | 99 | 2.30 |
| 25 (Comparative) | 71 | 1.62 |
| 26 (Comparative) | 57 | 1.47 |
| 27 | 68 | 1.59 |

The samples were then subjected to a fading test under the following conditions:

1. Dark fading A: 70° C., 80% R H, 14 days
2. Dark fading B: 77° C., dry (no humidification), 14 days
3. Light fading: Exposed to xenon fadeometer for 400 hrs.

The evaluation of the resistance to fading was made in terms of "percent of residual dye" as in Example 1. The results are shown in Table 10.

TABLE 10

| | Percent of residual dye | | |
|---|---|---|---|
| Sample No. | Dark fading A | Dark fading B | Light fading |
| 19 (Comparative) | 77 | 48 | 42 |
| 20 (Comparative) | 90 | 63 | 51 |
| 21 | 92 | 66 | 54 |
| 22 (Comparative) | 79 | 52 | 41 |
| 23 (Comparative) | 91 | 64 | 50 |
| 24 | 92 | 67 | 52 |
| 25 (Comparative) | 92 | 72 | 29 |
| 26 (Comparative) | 93 | 75 | 31 |
| 27 | 94 | 76 | 34 |

As the data in Table 10 shows, the samples according to the present invention produced cyan dye images that were highly resistant to light and wet heat. Comparative Samples 20 and 22 used only benzotriazole base UV absorbers, and after their preparation, the hydrophobic substances crystallized on the surface to provide a matte appearance. But this did not occur in the samples of the present invention, indicating the high solubility and dispersibility of the compounds of formula (I) in organic solvents.

EXAMPLE 4

Sample 28 was prepared from the layers formulation indicated in Table 11.

TABLE 11

| Layer No. | | Silver coat (mg/100 cm$^2$) | Gelatin coat (mg/100 cm$^2$) | UV absorber | Coupler | High-boiling organic solvent |
|---|---|---|---|---|---|---|
| 6 | (Protective layer) | — | 15 | — | — | — |
| 5 | (Red-sensitive emulsion layer) | 3.0 | 20 | — | (C - 6) 6.0 | DOP 3.0 |
| 4 | (2nd intermediate layer) | — | 20 | 6.0 | — | DOP 5.0 |
| 3 | (Green-sensitive emulsion layer) | 3.0 | 20 | — | (M - 9) 6.1 | TCP 5.0 |
| 2 | (1st intermediate layer) | — | 10 | — | — | — |
| 1 | (Blue-sensitive emulsion layer) | 4.0 | 20 | — | (Y - 19) 10.0 | DBP 6.0 |
| | Polyethylene-coated paper | | | | | |

Samples 29 to 32 were prepared from the same layers formulation as shown in Table 11 except that the couplers used in layers 1, 3 and 5 contained the anti-fading agents listed in the following table.

TABLE 12

| Sample No. | Percent of residual dye: Yellow Dark fading A | Yellow Dark fading B | Yellow Light fading C | Magenta Dark fading A | Magenta Dark fading B | Magenta Light fading C | Cyan Dark fading A | Cyan Dark fading B | Cyan Light fading C |
|---|---|---|---|---|---|---|---|---|---|
| 28 (Control) | 90 | 95 | 33 | 93 | 97 | 42 | 79 | 52 | 41 |
| 29 | 91 | 95 | 54 | 93 | 97 | 53 | 87 | 72 | 54 |
| 30 | 90 | 96 | 56 | 94 | 97 | 52 | 88 | 71 | 52 |
| 31 | 91 | 96 | 54 | 93 | 98 | 52 | 94 | 74 | 50 |
| 32 (Comparative) | 90 | 94 | 45 | 93 | 96 | 54 | 89 | 72 | 44 |

| Sample No. | Yellow coupler containing layer | Magenta coupler containing layer | Cyan coupler containing layer |
|---|---|---|---|
| 29 | Compound (1) of the present invention (3.0 mg) | — | — |
| 30 | Compound (3) of the present invention (3.0 mg) | — | — |
| 31 | Compound (1) of the present invention (3.0 mg) | Compound (2) of the present invention (3.0 mg) | Compound (1) of the present invention (2.0 mg) |
| 32 | Comparative anti-fading agent (B-1) (3.0 mg) | Comparative anti-fading agent (G-2) (3.0 mg) | Comparative anti-fading agent (R-1) (2.0 mg) |

Comparative anti-fading agent B-1 is known and has the following formula as noted in German patent application (OLS) No. 2,126,954:

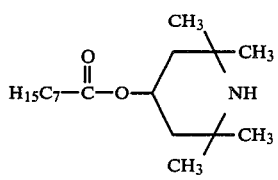

The samples were processed and their relative sensitivity and maximum reflection density were measured as in Example 1. Samples 29 to 31 according to the present invention had the same photographic characteristics as those of control sample 28. However, a marked desensitization occurred in the yellow and cyan dyes in comparative sample 32 and their color formation was very inadequate.

Each sample was exposed to three different lights, blue, green and red, so as to provide a sample having the image separated into three colors, yellow, magenta and cyan. The so prepared samples were subjected to fading tests as in Example 3. The results are shown in Table 12.

As the above data shows, the samples according to the present invention produced durable images, and they were particularly effective in preventing the light fading of yellow dyes and the dark fading of cyan dyes.

EXAMPLE 5

Nine samples of silver halide color photographic material having the layers formulation indicated in Table 13 were prepared.

TABLE 13

| | | Silver coating (mg/100 cm$^2$) | Gelatin coating (mg/100 cm$^2$) | Coupler dispersion |
|---|---|---|---|---|
| Layer 2 | Protective layer | — | 20 | — |
| Layer 1 | Blue-sensitive emulsion layer | 4.0 | 25 | See Table 14. |
| Polyethylene-coated paper as a support | | | | |

The compositions of the coupler dispersions used in preparing the blue-sensitive emulsion layers of the respective samples are listed in Table 14.

TABLE 14

| Sample No. | Coupler and its amount (g) | Anti-fading agent and its amount (g) | Hydroquinone derivative and its amount (g) | High-boiling organic solvent and its amount (ml) | Low-boiling organic solvent and its amount (ml) | Remarks |
|---|---|---|---|---|---|---|
| 33 | (Y - 1) 31 | — | (Hq - 1) 0.6 | DBP 31 | EA 62 | Comparative |
| 34 | " | (14) 10 | " | " | " | According to the present invention |
| 35 | (Y - 5) 33 | — | " | " | " | Comparative |
| 36 | " | (14) 10 | " | " | " | According to the present invention |
| 37 | (Y - 19) 38 | — | " | DOP 33 | " | Comparative |
| 38 | " | (14) 10 | " | " | " | According to the present invention |
| 39 | " | (15) 10 | (Hq - 21) 0.5 | " | " | According to the present invention |
| 40 | (Y - 25) 36 | — | (hq - 1) 0.6 | TOP 36 | " | Comparative |
| 41 | " | (14) 10 | " | " | " | According to the present invention |

The samples thus prepared were processed and measured for their relative sensitivity and maximum reflection density as in Example 1. The results are shown in Table 15.

TABLE 15

| Sample No. | Coupler and its amount (g) | Anti-fading agent and its amount (g) | Comparative anti-fading agent and its amount (g) | Hydroquinone derivative and its amount (g) | High-boiling organic solvent and its amount (ml) | Low-boiling organic solvent and its amount (ml) | Remarks |
|---|---|---|---|---|---|---|---|
| 42 | (M - 1) 25 | — | — | (Hq - 1) 0.8 | TOP 25 | EA 63 | Comparative |
| 43 | " | — | (G - 1) 8 | " | " | " | " |
| 44 | " | (14) 8 | — | " | " | " | According to the present invention |
| 45 | (M - 3) 25 | — | — | (Hq - 21) 0.8 | TCP 25 | " | Comparative |
| 46 | " | — | (G - 2) 8 | " | " | " | " |
| 47 | " | (14) 8 | — | " | " | " | According to the present invention |
| 48 | (M - 9) 27 | — | — | (Hq - 1) 0.8 | TCP 25 | " | Comparative |
| 49 | " | — | (G - 3) 8 | " | " | " | " |
| 50 | " | (14) 8 | — | " | " | " | According to the present invention |

| Sample No. | Relative sensitivity | Max. reflection density |
|---|---|---|
| 33 (Comparative) | 80 | 2.10 |
| 34 | 81 | 2.10 |
| 35 (Comparative) | 91 | 2.32 |
| 36 | 90 | 2.32 |
| 37 (Comparative) | 100 | 2.45 |
| 38 | 101 | 2.46 |
| 39 | 100 | 2.44 |
| 40 (Comparative) | 95 | 2.34 |
| 41 | 95 | 2.34 |

The above data shows that the compounds according to the present invention had no adverse effects on the photographic characteristics.

The respective samples were subjected to a light fading test as in Example 1 and the results are shown in Table 16.

TABLE 16

| | Xenon fadeometer (200 hrs.) | | Sunlight (20 days) | |
|---|---|---|---|---|
| Sample No. | Percent of residual dye | Yellowing | Percent of residual dye | Yellowing |
| 33 (Comparative) | 33 | 0.04 | 48 | 0.05 |
| 34 | 52 | 0.02 | 67 | 0.03 |
| 35 (Comparative) | 65 | 0.03 | 59 | 0.04 |
| 36 | 78 | 0.02 | 72 | 0.03 |
| 37 (Comparative) | 61 | 0.03 | 56 | 0.04 |
| 38 | 74 | 0.02 | 71 | 0.03 |
| 39 | 73 | 0.02 | 69 | 0.03 |
| 40 (Comparative) | 45 | 0.03 | 50 | 0.04 |
| 41 | 70 | 0.02 | 69 | 0.03 |

The data in Table 16 shows that the samples of the present invention were much improved over the comparative samples with respect to the resistance of the yellow dyes to light fading and the yellowing of the white background.

EXAMPLE 6

Nine samples of silver halide color photographic material were prepared as in Example 5 except that the blue-sensitive emulsion layers were replaced by green-sensitive emulsion layers containing magenta couplers. The compositions of the coupler dispersions used in preparing the respective green-sensitive emulsion layers are shown in Table 17.

TABLE 17

The respective samples were processed and measured for their relative sensitivity and maximum reflection density as in Example 5. The results are shown in Table 18. The samples of the present invention show little or no reduction in relative sensitivity and reflection density as compared with the comparative examples.

TABLE 18

| Sample No. | Relative sensitivity | Max. reflection density |
|---|---|---|
| 42 (Comparative) | 98 | 2.40 |
| 43 (Comparative) | 94 | 2.37 |
| 44 | 98 | 2.39 |
| 45 (Comparative) | 95 | 2.41 |
| 46 (Comparative) | 92 | 2.38 |
| 47 | 95 | 2.41 |
| 48 (Comparative) | 100 | 2.37 |
| 49 (Comparative) | 99 | 2.36 |
| 50 | 100 | 2.37 |

The samples were subjected to a light fading test as in Example 5, and the results are shown in Table 19.

TABLE 19

| | Xenon fadeometer (100 hrs.) | | Sunlight (10 days) | |
|---|---|---|---|---|
| Sample No. | Percent of residual dye | Yellowing | Percent of residual dye | Yellowing |
| 42 (Comparative) | 51 | 0.14 | 53 | 0.16 |
| 43 (Comparative) | 70 | 0.10 | 71 | 0.14 |
| 44 | 70 | 0.10 | 70 | 0.13 |
| 45 (Comparative) | 56 | 0.13 | 59 | 0.14 |
| 46 (Comparative) | 73 | 0.11 | 74 | 0.12 |
| 47 | 74 | 0.11 | 74 | 0.11 |
| 48 (Comparative) | 48 | 0.14 | 50 | 0.15 |
| 49 (Comparative) | 69 | 0.11 | 69 | 0.11 |
| 50 | 70 | 0.12 | 69 | 0.10 |

The above data shows that the compounds of the present invention were effective not only in suppressing the fading of magenta dyes due to exposure to light but also in preventing the yellowing of the white background due to the photolysis of unreacted magenta couplers.

EXAMPLE 7

Nine samples of silver halide color photographic material were prepared as in Example 5 except that the blue-sensitive emulsion layers were replaced by red-sensitive emulsion layers containing cyan couplers. The compositions of the coupler dispersions used in preparing the red-sensitive emulsion layers are shown in Table 20.

TABLE 20

| Sample No. | Coupler and its amount (g) | Anti-fading agent and its amount (g) | Comparative anti-fading agent and its amount (g) | Hydroquinone derivative and its amount (ml) | High-boiling organic solvent and its amount (ml) | Low-boiling organic solvent and its amount (ml) | Remarks |
|---|---|---|---|---|---|---|---|
| 51 | (C - 5) 21 | — | — | (Hq - 1) 0.3 | DBP 10 | EA 53 | Comparative |
| 52 | " | — | (R - 1) 7 | " | " | " | " |
| 53 | " | (14) 7 | — | " | " | " | According to the present invention |
| 54 | (C - 6) 22 | — | — | " | DOP 11 | " | Comparative |
| 55 | " | — | (R - 2) 7 | " | " | " | " |
| 56 | " | (14) 7 | — | " | " | " | According to the present invention |
| 57 | (C - 15) 26 | — | — | " | DOP 26 | " | Comparative |
| 58 | " | — | (R - 3) 7 | " | " | " | " |
| 59 | " | (14) 7 | — | " | " | " | According to the present invention |

The samples thus prepared were processed and measured for their relative sensitivity and maximum reflection density as in Example 5. The results are shown in Table 21. The samples of the present invention show little or no reduction in sensitivity and density as compared with the comparative examples.

TABLE 21

| Sample No. | Relative sensitivity | Max. reflection density |
|---|---|---|
| 51 (Comparative) | 100 | 2.31 |
| 52 (Comparative) | 94 | 2.15 |
| 53 | 98 | 2.28 |
| 54 (Comparative) | 100 | 2.33 |
| 55 (Comparative) | 92 | 2.14 |
| 56 | 99 | 2.30 |
| 57 (Comparative) | 71 | 1.62 |
| 58 (Comparative) | 57 | 1.47 |
| 59 | 68 | 1.59 |

The samples were subjected to a fading test as in Example 3. The evaluation of the resistance to fading was made in terms of "percent of residual dye" as in Example 5. The results are shown in Table 22.

TABLE 22

| Sample No. | Percent of residual dye | | |
|---|---|---|---|
| | Dark fading A | Dark fading B | Light fading |
| 51 (Comparative) | 77 | 48 | 42 |
| 52 (Comparative) | 90 | 63 | 51 |
| 53 | 93 | 66 | 50 |
| 54 (Comparative) | 79 | 52 | 41 |
| 55 (Comparative) | 91 | 64 | 50 |
| 56 | 94 | 68 | 52 |
| 57 (Comparative) | 92 | 72 | 29 |
| 58 (Comparative) | 93 | 75 | 31 |
| 59 | 94 | 77 | 34 |

As the data in Table 22 shows, the samples according to the present invention produced cyan dye images that were highly resistant to light and wet heat. Comparative samples 52 and 54 used only benzotriazole base UV absorbers, and after their preparation, the hydrophobic substances crystallized on the surface to provide a matte appearance. But this did not occur in the samples of the present invention, indicating the high solubility and dispersibility of the compounds (I) or (II) in organic solvents.

EXAMPLE 8

Sample 60 was prepared from the layers formulation indicated in Table 23.

TABLE 23

| Layer No. | | Silver coat (mg/100 cm$^2$) | Gelatin coat (mg/100 cm$^2$) | UV absorber | Coupler | High-boiling organic solvent |
|---|---|---|---|---|---|---|
| 6 | (Protective layer) | — | 15 | — | — | — |
| 5 | (Red-sensitive emulsion layer) | 3.0 | 20 | — | (C - 6) 6.0 | (DOP)* 3.0 |
| 4 | (2nd intermediate layer) | — | 20 | 6.0 | — | (DOP)* 5.0 |
| 3 | (Green-sensitive emulsion layer) | 3.0 | 20 | — | (M - 9) 6.1 | (TCP)** 5.0 |
| 2 | (1st intermediate layer) | — | 10 | — | — | — |

TABLE 23-continued

| Layer No. | | Silver coat (mg/100 cm²) | Gelatin coat (mg/100 cm²) | UV absorber | Coupler | High-boiling organic solvent |
|---|---|---|---|---|---|---|
| 1 | (Blue-sensitive emulsion layer) | 4.0 | 20 | — | (Y - 19) 10.0 | (DBP)*** 6.0 |
| Polyethylene-coated paper | | | | | | |

*DOP: dioctyl phthalate
**TCP: tricresyl phosphate
***DBP: dibutyl phthalate

Samples 61 to 64 were prepared from the same formulation as shown in Table 23 except that the couplers used in layers 1, 3 and 5 contained the anti-fading agents listed in the following table.

| Sample No. | Yellow coupler containing layer | Magenta coupler containing layer | Cyan coupler containing layer |
|---|---|---|---|
| 61 | Compound (14) of the present invention (3.0 mg) | — | — |
| 62 | Compound (16) of the present invention (3.0 mg) | — | — |
| 63 | Compound (14) of the present invention (3.0 mg) | Compound (15) of the present invention (3.0 mg) | Compound (14) of the present invention (2.0 mg) |
| 64 | Comparative anti-fading agent (B-1) (3.0 mg) | Comparative anti-fading agent (G-2) (3.0 mg) | Comparative anti-fading agent (R-1) (2.0 mg) |

The samples were processed and their relative sensitivity and maximum reflection density were measured as in Example 5. Samples 61 to 63 according to the present invention had the same photographic characteristics as those of control sample 60. However, a marked densitization occurred in the yellow and cyan dyes in comparative sample 64 and their color formation was very unsatisfactory.

Each sample was exposed to three different lights, blue, green and red, so as to provide a sample having the image separated into three colors, yellow, magenta and cyan. The so prepared samples were subjected to fading tests as in Example 7. The results are shown in Table 24.

TABLE 24

| Sample No. | Percent of residual dye | | | | | | | | |
|---|---|---|---|---|---|---|---|---|---|
| | Yellow | | | Magenta | | | Cyan | | |
| | Dark fading A | Dark fading B | Light fading | Dark fading A | Dark fading B | Light fading | Dark fading A | Dark fading B | Light fading |
| 60 (Control) | 90 | 95 | 33 | 93 | 97 | 42 | 79 | 52 | 41 |
| 61 | 91 | 95 | 54 | 93 | 97 | 53 | 87 | 73 | 51 |
| 62 | 91 | 96 | 53 | 93 | 97 | 52 | 90 | 74 | 50 |
| 63 | 91 | 96 | 54 | 93 | 97 | 54 | 90 | 73 | 49 |
| 64 (Comparative) | 90 | 94 | 45 | 93 | 96 | 54 | 89 | 72 | 44 |

As the above data shows, the samples according to the present invention produced durable images, and they were particularly effective in preventing the light fading of yellow dyes and the dark fading of cyan dyes.

What is claimed is:

1. A silver halide color photographic product having at least one dye image forming layer on a support, which further contains at least one of the compounds of formula (I) or (II) in said dye image forming layer and/or an adjoining or an adjacent layer:

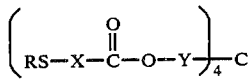

(I)

wherein R is an alkyl group, an aryl group or a heterocyclic group; X is an alkylene group; and Y is an alkylene or arylene group; and

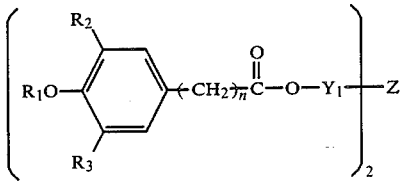

(II)

wherein $R_1$ is a hydrogen atom, an alkyl group or an aryl group; $R_2$ and $R_3$ are each an alkyl group; $Y_1$ is an alkylene or arylene group; Z is an oxygen atom, a sulfur atom, a sulfonyl group, a carbonyl group or an alkylene group; and n is an integer of 1 to 20.

2. A silver halide color photographic product according to claim 1, wherein said alkyl group represented by R in formula (I) is an alkyl group having 1 to 20 carbon atoms.

3. A silver halide color photographic product according to claim 1, wherein said aryl group represented by R in formula (I) is a phenyl group.

4. A silver halide color photographic product according to claim 3, wherein said phenyl group in formula (I) is substituted with an alkyl group having 1 to 5 carbon atoms.

5. A silver halide color photographic product according to claim 1, wherein said alkylene group represented by X in formula (I) is an alkylene group having 1 to 4 carbon atoms.

6. A silver halide color photographic product according to claim 1, wherein said arylene group represented by Y in formula (I) is a phenylene group.

7. A silver halide color photographic product according to claim 1, wherein said alkyl group represented by $R_1$ in formula (II) is an alkyl group having 1 to 6 carbon atoms.

8. A silver halide color photographic product according to claim 1, wherein said aryl group represented by $R_1$ in formula (II) is a phenyl group.

9. A silver halide color photographic product according to claim 1, wherein said alkyl group represented by each of $R_2$ and $R_3$ in formula (II) is an alkyl group having 1 to 6 carbon atoms.

10. A silver halide color photographic product according to claim 1, wherein said alkylene group represented by $Y_1$ in formula (II) is an alkylene group having 1 to 4 carbon atoms.

11. A silver halide color photographic product according to claim 1, wherein said arylene group represented by $Y_1$ in formula (II) is a phenylene group.

12. A silver halide color photographic product according to claim 1, wherein said Z in formula (II) is an oxygen atom or a sulfur atom.

13. A silver halide color photographic product according to claim 1, wherein said dye image forming layer and/or said adjoining or said adjacent layer contain a yellow or a cyan coupler.

14. A silver halide color photographic product according to claim 13, wherein said yellow coupler is one having formula (III):

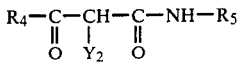

(III)

wherein $R_4$ is an alkyl group or an aryl group; $R_5$ is an aryl group; and $Y_2$ is a hydrogen atom or a group that is eliminated during color development reaction.

15. A silver halide color photographic product according to claim 13, wherein said cyan coupler is one having formula (V):

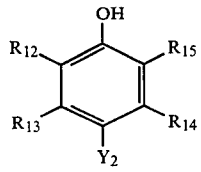

(V)

wherein $Y_2$ is the same as defined in formula (III); and $R_{12}$, $R_{13}$, $R_{14}$ and $R_{15}$ are each a hydrogen atom, a halogen atom, an alkyl group, a carbamoyl group, a sulfamoyl group, an amide group, a sulfonamide group, a phosphamide group or a ureido group.

16. A silver halide color photographic product according to claim 1, wherein said n is an integer of 1 to 5.

17. A silver halide color photographic product according to claim 1, wherein said X and Y in formula (I) are each an alkylene group having 1 to 4 carbon atoms.

18. A silver halide color photographic product according to claim 1, wherein said R in formula (I) is an alkyl group having 1 to 20 carbon atoms.

19. A silver halide color photographic product according to claim 1, wherein said Z in formula (II) is a sulfur atom.

* * * * *